US009750357B2

(12) United States Patent
Hopp

(10) Patent No.: US 9,750,357 B2
(45) Date of Patent: Sep. 5, 2017

(54) FRAMELESS FLAT ARTWORK MOUNTING APPARATUS

(71) Applicant: William Hopp, Las Vegas, NV (US)

(72) Inventor: William Hopp, Las Vegas, NV (US)

( * ) Notice: Subject to any disclaimer, the term of this patent is extended or adjusted under 35 U.S.C. 154(b) by 0 days.

(21) Appl. No.: 15/264,534

(22) Filed: Sep. 13, 2016

(65) Prior Publication Data

US 2017/0188725 A1 Jul. 6, 2017

Related U.S. Application Data

(60) Provisional application No. 62/218,437, filed on Sep. 14, 2015.

(51) Int. Cl.

| | |
|---|---|
| ***A47G 1/06*** | (2006.01) |
| ***A47G 1/16*** | (2006.01) |
| ***A47G 1/24*** | (2006.01) |

(52) U.S. Cl.

CPC ..... *A47G 1/0638* (2013.01); *A47G 1/1606* (2013.01); *A47G 1/24* (2013.01); *A47G 2001/0677* (2013.01)

(58) Field of Classification Search

CPC ..... G09F 15/0025; G09F 1/14; G09F 17/00; E06B 9/521; E06B 9/52

USPC ..... 160/327, 328, 379

See application file for complete search history.

(56) References Cited

U.S. PATENT DOCUMENTS 445,305 A 1/1891 Tidball
1,056,636 A 3/1913 Davison
1,705,052 A * 3/1929 Viscount ..... G09F 1/14 116/173
1,771,532 A * 7/1930 Ford ..... G09F 13/04 40/367
1,863,594 A * 6/1932 Glende ..... G09F 1/14 248/460
2,069,484 A * 2/1937 Stucbing, Jr. ..... G09F 1/14 40/603
2,099,538 A * 11/1937 Schultz ..... A47G 1/0633 40/761
2,353,625 A * 7/1944 Moore ..... A47G 1/14 160/329

(Continued)

FOREIGN PATENT DOCUMENTS

| | | |
|---|---|---|
| EP | 2331347 B1 | 4/2014 |
| GB | 1282979 A | 7/1972 |
| WO | 9853440 A | 11/1998 |

OTHER PUBLICATIONS http://www.ebay.com/itm/like/141786772801?lpid=82&chn=ps&ul_noapp=true, Universal Detachable Tablet Wall Mount for iPad 1/2/3/4/Air/Galaxy.

*Primary Examiner* — Cassandra H Davis

(74) *Attorney, Agent, or Firm* — Lesley A. Wallerstein, LLC

(57) ABSTRACT

I disclose a frameless display apparatus for flat or essentially flat artwork. The apparatus comprises a transparent envelope with flaps to fold around the edges of the flat artwork. Four perpendicular pairs of rods meet at a hub to create a T-shaped cross brace. Clips on the terminal ends of each pair of rods couple to the edges of the enclosed artwork to stabilize the artwork from twisting in place. The artwork and cross brace rest directly in a wall mount, or spaced forward of the wall with one or more interlocking forward extension elements.

6 Claims, 15 Drawing Sheets

(56) References Cited

U.S. PATENT DOCUMENTS

| | | | | | |
|---|---|---|---|---|---|
| 2,632,971 | A | | 3/1953 | Manczek et el | |
| 2,805,504 | A | * | 9/1957 | Stein | A47G 1/141 40/603 |
| 2,809,453 | A | * | 10/1957 | Pawelka | G09F 7/18 40/603 |
| 2,919,512 | A | * | 1/1960 | Higgins | A47G 1/141 248/459 |
| 2,934,846 | A | * | 5/1960 | Stein | G09F 15/0056 40/603 |
| 2,939,237 | A | * | 6/1960 | Stein | G09F 1/10 40/311 |
| 2,967,592 | A | * | 1/1961 | Stein | F16B 7/10 248/200.1 |
| 3,591,940 | A | * | 7/1971 | Slemmons | G09F 1/10 40/603 |
| 3,936,968 | A | | 2/1976 | Gilbert | |
| 4,426,800 | A | * | 1/1984 | Brown | G09F 7/00 116/173 |
| 4,442,617 | A | * | 4/1984 | Frye | A47G 1/141 40/661 |
| D281,317 | S | | 11/1985 | Whitaker | |
| 5,090,143 | A | | 2/1992 | Schier et al. | |
| D358,716 | S | * | 5/1995 | Chenevert | D30/101 |
| 6,003,825 | A | | 12/1999 | Abernathy | |
| 6,135,191 | A | * | 10/2000 | Mitchell | B60J 1/2011 160/134 |
| 6,357,461 | B1 | * | 3/2002 | Chai | B60J 1/2011 135/117 |
| D557,126 | S | | 12/2007 | Worrall et al. | |
| 7,974,004 | B2 | * | 7/2011 | Maruyama | G03B 21/58 160/351 |
| 8,215,041 | B2 | * | 7/2012 | Hill | G09F 1/06 40/603 |
| 8,864,095 | B1 | | 10/2014 | Marks | |
| 9,038,982 | B1 | | 5/2015 | Marks | |
| 9,183,768 | B2 | * | 11/2015 | Maguire | G09F 15/0062 |
| 9,266,384 | B2 | | 2/2016 | Os et al. | |
| 9,297,495 | B2 | * | 3/2016 | Fischer | F16M 11/041 |
| 2005/0204602 | A1 | | 9/2005 | Davies | |

* cited by examiner

FRAMELESS FLAT ARTWORK MOUNTING APPARATUS

CROSS-REFERENCE TO RELATED APPLICATION (not applicable)

STATEMENT REGARDING FEDERALLY SPONSORED RESEARCH OR DEVELOPMENT (not applicable)

NAMES OF PARTIES TO A JOINT RESEARCH AGREEMENT (not applicable)

REFERENCE TO SEQUENCE LISTING, A TABLE OR A COMPUTER PROGRAM LISTING COMPACT DISC APPENDIX (not applicable)

FIELD OF THE INVENTION

This invention relates to an apparatus for framelessly mounting and displaying flat artwork on a wall.

BACKGROUND OF THE INVENTION

In our digital age, it is becoming increasingly easier to create and duplicate flat artwork. Posters and photographs can be produced in a staggering variety of media, sizes and proportions, for comparatively little money.

The frames that display artwork are just as important a consideration. They are a design statement in their own right: thin, thick, with a matt, wood, plastic or metal. Furthermore, the material covering the artwork can determine how long it lasts—thin acetate on one end of the spectrum, and ultraviolet light-resistant, glare-free, museum quality glass on the other end. When you add up all of the materials that go into framing artwork, the frame and glass can often be more expensive than the artwork itself.

What to do, then, when one wants the artwork itself to be the statement? Until now, the options are museum putty, or sandwiching the artwork between two sheets of glass, a sheet of acetate and Masonite and clipping them together. Museum putty is quick, cheap and convenient, but stains paint and loses its adherence over time. Tacks and push pins also technically work, but they create holes, and are unsightly. For larger pictures, such as movie posters, the art often tears off the tacks, falling to the floor. Acetate and Masonite poster hanging kits are widely available in chain craft and hobby stores, but what if you can't find it in the right size? Two pieces of sheet glass look most professional, but where do you find the hardware to hold it together? And again, where can you have it custom made? What if there was a way to display flat artwork of any height and width on a wall without the expense and bother of frames, and with only simple tools?

BRIEF SUMMARY OF THE INVENTION

In accordance with one embodiment of the invention, I provide a snap-together, frameless mounting and display apparatus for displaying flat artwork. There are no frames and no borders surrounding the artwork. All the viewer sees is the artwork itself against the wall. The apparatus remains hidden behind the artwork. No tools are required to assemble the apparatus, and a common hammer and nails can mount it to the wall.

The apparatus comprises a flexible and transparent rectangular envelope which encloses the artwork, a rigid brace to stabilize the envelope in three dimensions, a wall mount into which the brace securely snaps, and, optionally, at least one extension bracket to push the artwork further away from the wall.

The rectangular envelope comprises a thin sheet of transparent polyethylene terephthalate glycol (PETG). The PETG can be glossy or matte. The envelope has an open configuration and a folded configuration. The envelope also has a right side and a wrong side. In the open configuration, the envelope is generally rectangular, with four edges, a top flap, a bottom flap, a left flap and a right flap defined by fold lines. The four fold lines together define an area within which the artwork is laid, enclosed and displayed. When the envelope is not in use, it is flexible enough to be rolled into a tube, from either the flat or the folded configuration.

Each corner of the open rectangle is cut off in an isosceles right triangle so that when each flap is folded on the fold line, the edges of the flaps meet perfectly mitered and form a similar, but smaller, rectangle matching a length and width dimension of the artwork to be displayed. The fold lines are scored only part way into the envelope, causing the flaps to only fold in one direction, toward the wrong side. In practice, the envelope is laid out in the open configuration and the flat artwork laid inside, the right side of the artwork facing the wrong side of the envelope and the wrong side of the artwork facing the user. The apparatus is optimally configured for flat artwork, such as those in sheet form like photographs, posters, or drawings on paper, paintings on canvas. The edges of the artwork are lined up with the fold lines and the flaps folded over to enclose those edges. Optionally, additional fold lines can be scored into the envelope to create options for enclosing and displaying thicker, multi-sheet artwork, such as covers of comic books or trade paperback books.

Each flap has a retention slot cut out at its midpoint, starting from the edge of the unfolded rectangle, running perpendicular to the edge and stopping short of the flap fold line. The piece of envelope remaining between the end of the retention slot and the fold line serves as a tab to rest on, position and stabilize the envelope within the brace.

In the embodiment shown in the drawings, the brace comprises a hub, four pairs of spaced-apart parallel rods snapped to the hub in one plane, radiating 90 degrees apart. It resembles a plus sign or a lowercase t. Each pair of spaced-apart parallel rods has an end that snaps into the hub, and an opposing end that snaps into a clip. It is important to use spaced-apart parallel rods, rather than a single rod, to brace the artwork. The pair of rods working in tandem prevents the artwork from twisting forward and backward in space. Each such clip in turn has space to receive and retain a corresponding envelope flap. The clip has a distinct front and back side, joined at a top and a bottom with bars. The slots and tabs on each flap of the envelope rest on the top bar, preventing vertical and horizontal motion. When all four edges of the envelope are inserted into the corresponding clips in this way, the envelope cannot move in any direction. It is not being pulled by tension, but rather, is simply held by the envelope perfectly fitting into the brace.

In a preferred embodiment, the hub itself is also generally shaped like a plus sign or lowercase "t," comprising a central square, with coplanar rectangular extensions radiating away from each edge of the square. Each extension of the plus sign has a pair of spaced-apart rod retainer elements positioned within the extension and dimensioned to accept a corresponding pair of spaced-apart parallel rods. Each rod in the pair has a hub and a clip end. In the embodiment shown, the spaced-apart rod retainer elements are shaped like a C. The diameter of the C is the same as the diameter of the rod, so that the rod snaps tightly into place. The hub also has four pairs of stops integrated into the edge of the square and spaced distally from the extensions. These stops block the hub from sliding along the rods. In this way, the hub ends of the four pairs of parallel rods can be slid into the C-shaped rod retainer elements and up against the edge of the central square, thereby creating a larger plus sign shape.

The back of each clip also has two spaced-apart rows of three C-shaped rod retainer elements. The clip end of each rod can be slid through the three C-shaped rod retainer elements. A corresponding pair of stops distal to the three C-shaped rod retainer elements prevents each clip from sliding vertically down the pair of rods. The envelope flap inserts into the clip from above and between the front of the clip and the back of the clip. When the envelope slot is slid over the top bar, the tab in the envelope rests on the top bar and prevents the envelope from shifting vertically and horizontally. Not only does the bottom bar stabilize the clip, but it also rests on the wall mount. A plug projecting downward from the back of the clip further secures the clip to the wall mount.

The wall mount has a front facing surface and a back facing surface. The front facing surface of the wall mount notably has a pair of spaced-apart parallel slots centered between the pair of fastener positioning holes, dimensioned to receive the pair of rods of the brace. It is a close, but not snap-tight, fit. This allows the brace to rest within and atop the wall mount, then be easily lifted out. The front facing surface also has an integral groove cut thereinto which is dimensioned to receive the plug. In this way, the clip rests atop as well as within the wall mount. Mounted correctly, the brace is retained closely, though not loosely, within the wall mount. The plug fits into the groove, and the rods fit into the slots, securing the brace from shifting up and down, right and left, as well as forward and backward.

This same groove in the wall mount can also accommodate an optional forward extension bracket. The forward extension bracket allows the brace to be mounted forward of the wall. Thus, the brace can be either directly mounted against the wall, or alternatively, indirectly mounted to project forward in space. The front facing surface of the wall mount can only accept at any given time either a pair of parallel rods and plug, or a forward extension bracket, never both at the same time. In an alternative embodiment, the forward extension bracket can also connect the wall mount to the hub. In another alternative embodiment, a connector can slide up and down the spaced-apart pair of parallel rods and couple to the wall mount, allowing a user to vary the vertical positioning of the brace without moving the wall mount.

The back facing surface is flush to and can be permanently secured to a wall. The front facing surface of the wall mount has a pair of spaced-apart fastener positioning holes running through the entire wall mount from the front facing side to the back facing side. The fastener positioning holes accept nails, screws, anchors or similar permanent fastening device. The wall mount can also be affixed to the wall without using fasteners and holes, such as with an adhesive, such as Command® brand repositionable wall adhesive.

The forward extension bracket couples the clip of the brace to the front facing surface of the wall, and pushes the artwork forward into space relative to the wall, when a user wants the flat artwork to sit away from, and not directly against, the wall. To frame a piece of flat artwork, a user lays the flat artwork face down into the envelope in the unfolded configuration. It is important to align the edges of the artwork with the fold lines. The flaps are folded inward and over the edges of the artwork, thereby enclosing the artwork in the envelope. The user places the enclosed artwork front side down on a work surface, and lays the brace atop the back side of the artwork. He locates the notch in each flap and slides the notch over the bar of each clip. The brace thus holds the enclosed artwork flat, but not stretched. The brace-envelope assembly in this position can then be slid directly into the wall mount at any of four orientations, or into a forward extension bracket, which itself gets snapped into the wall mount.

REFERENCE NUMERALS

Figure 1:
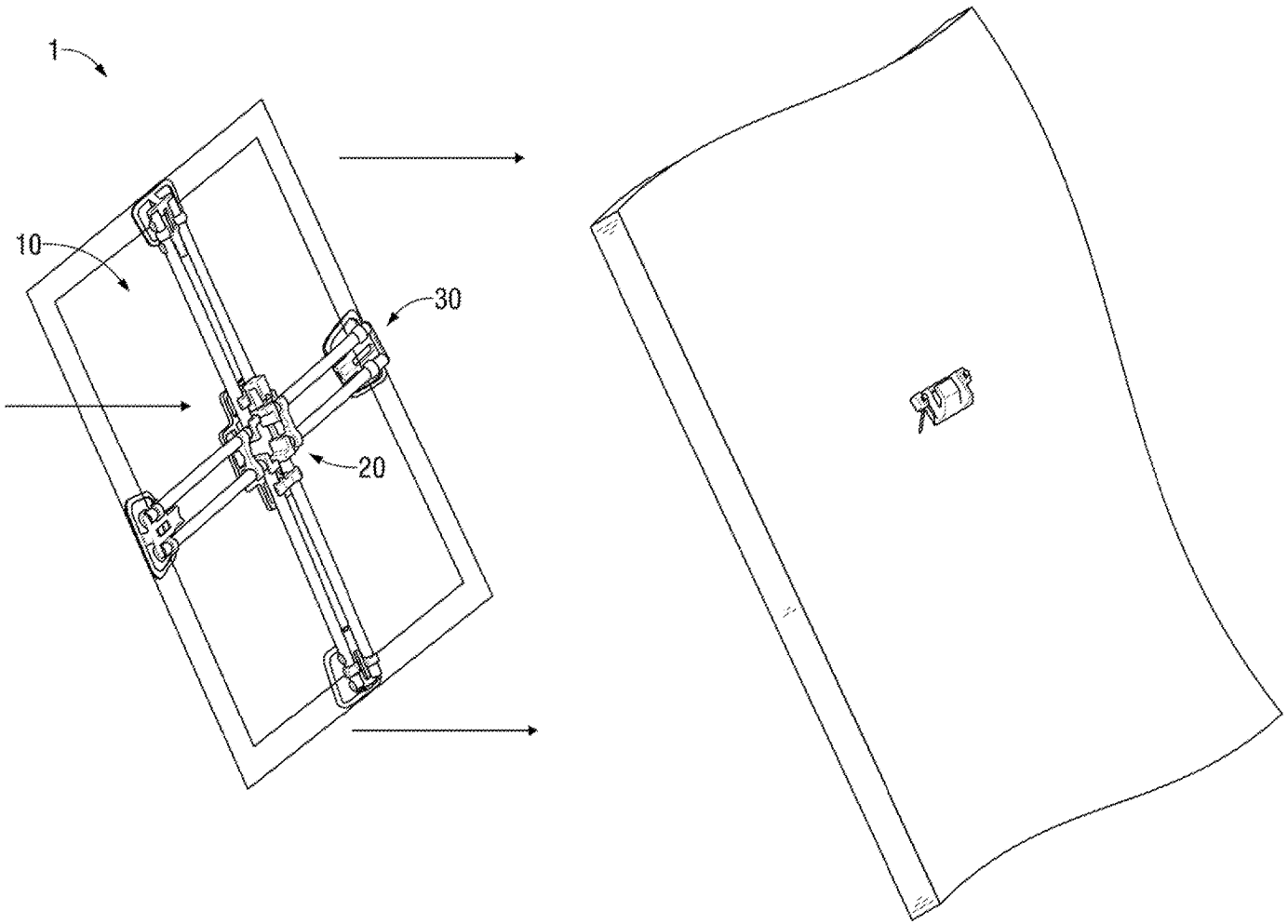
FIG. 1 is a perspective view of a frameless flat artwork mounting and display apparatus, being mounted on a wall

1 Frameless flat artwork mounting and display apparatus
10 Envelope
11 Fold lines
12 Flaps
13 Retention slot
14 Tab

20 Brace
21 Hub
22 Central square
23 Extensions
24 C-shaped retainer elements, hub
25 Stops
26 Pair of parallel rods
27 Hub end of rod
28 Clip end of rod
30 Clip
31 Front of clip
32 Back of clip
33 Top bar
34 Bottom bar
35 C-shaped retainer elements, clip
36 Stopper end
37 Plug
40 Wall mount
41 Front-facing side
42 Fastener positioning holes
43 Slots
44 Groove
45 Back-facing side
50 Forward extension bracket
51 Male element
52 Female element

DETAILED DESCRIPTION OF THE INVENTION

FIG. 1 shows an overview of one embodiment of a frameless flat artwork mounting and display apparatus 1. An envelope 10 wraps around and partially encloses a piece of flat artwork (right side not shown in this view). A brace 20 stabilizes the artwork within the envelope 10. A wall mount 40 is permanently affixed to a wall. The brace 20 is set into the wall mount and displays the right side of the artwork to a viewer.

The envelope 10 is preferably transparent and colorless. Preferably, the envelope is made of polyethylene terephthalate glycol (PETG), because this material is thin, heat resistant to 150 F, malleable, rollable and holds a crease without cracking. The PETG can have a glossy or a matte finish. Preferably, the PETG envelope is 0.010 inch thick, although other thicknesses having the above properties are also within the scope of this invention. FIG. 4A shows additional details about the envelope.

FIG. 4A-4D shows the envelope 10 in more detail. Envelope 10 has an open configuration and a folded configuration, a front, and a back. FIG. 4A shows the back of envelope 10 in the open configuration. In FIG. 4A, envelope 10 is a rectangle of unequal sides, although a square could also be used. The dimensions of the rectangular or square envelope can be varied by those of ordinary skill in the art to accommodate flat artwork of a particular length and width. The envelope 10 in the open configuration has four edges and an isosceles right triangle cut off of each corner. Fold lines 11 are scored into the truncated rectangle equidistant to each edge of the rectangle. The area between the edge of the rectangle and a corresponding fold line 11 defines a flap 12. Note four such flaps 12 identified in FIG. 4A. In the embodiment illustrated, one set of four fold lines 11 is shown. The artwork rests atop and fills an area within and defined by the one set of fold lines. The dimensions of this area can also be varied by those of ordinary skill in the art to fit a particular size of artwork.

One such set of fold lines can enclose and accommodate a sheet of artwork, such as a drawing, photograph or a poster. In an alternative embodiment, not shown, a second set of fold lines can be scored into the envelope equidistant and perpendicular to and within the area defined by the first one set of fold lines. The second set of fold lines defines a flap that can fold twice. Such a bi-fold flap can neatly enclose and securely display within the apparatus relatively thicker pieces of artwork, such as comic books and trade paperback books. A slot 13 is cut at the midpoint of each flap perpendicular to and from the edge of the rectangle, toward but not all the way to the fold line 11. Tab 14 is a segment of envelope remaining between and end of the slot and the fold line 11.

Figure 4B:
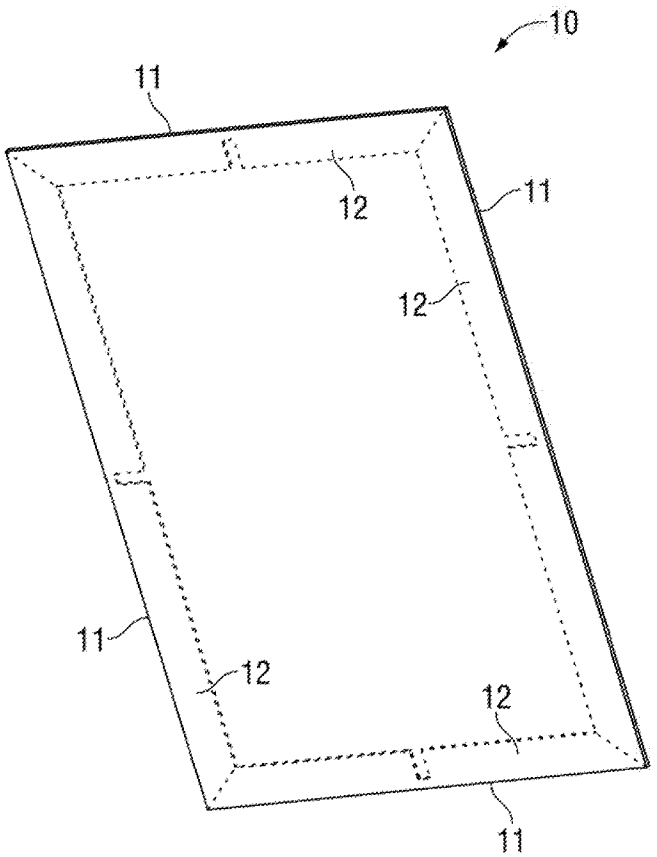
FIG. 4B is a perspective view of a front of the envelope in the folded configuration
Figure 4A:
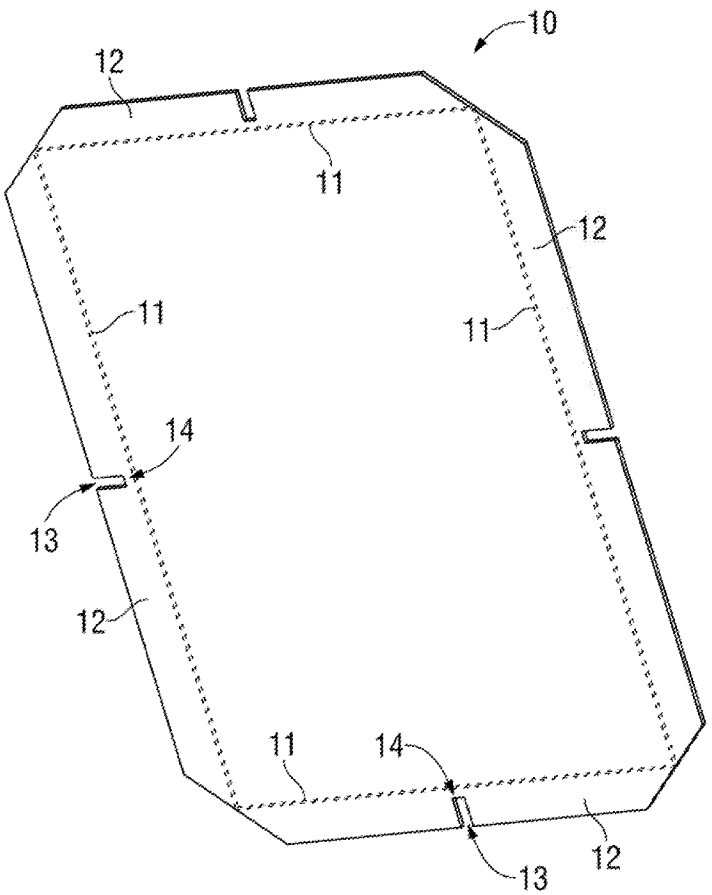
FIG. 4A is a perspective view of an envelope in an open configuration
Figure 4D:
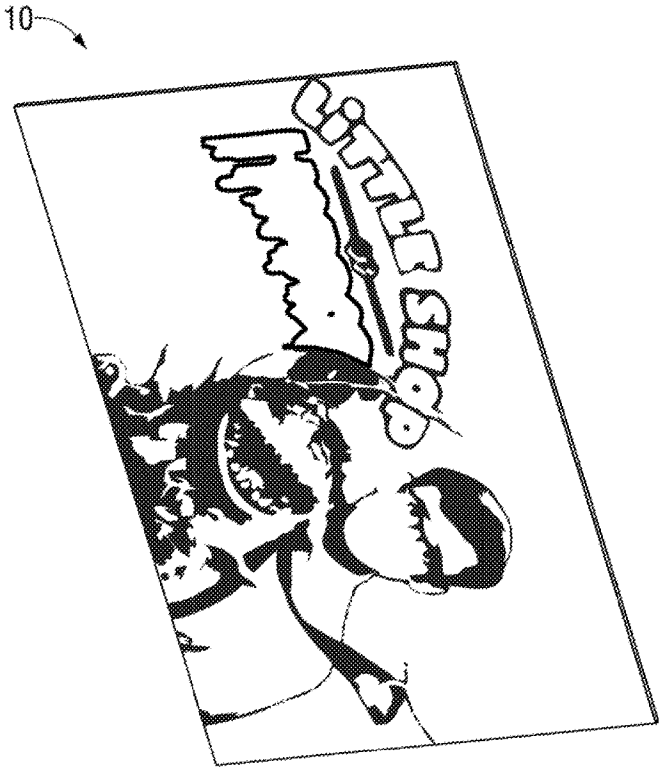
FIG. 4D is a perspective view of a front of the envelope in the folded configuration, and with artwork enclosed within
Figure 4C:
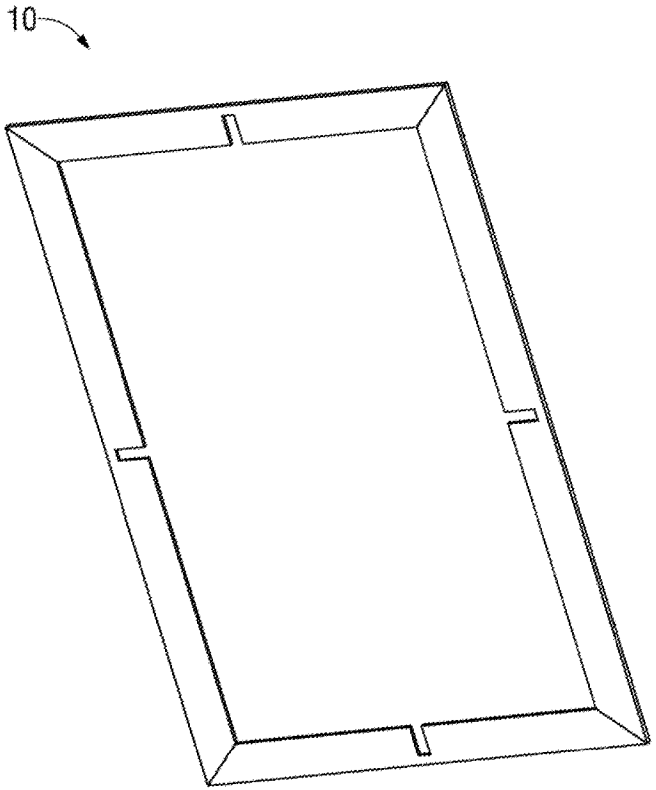
FIG. 4C is a perspective view of a back of the envelope in the folded configuration

FIG. 4B shows the front of an empty envelope 10 in the folded configuration. Phantom lines show how the four flaps 12 have been folded back at the fold lines 11 to meet perfectly mitered at the back of the envelope. FIG. 4C shows the back of an envelope in the folded configuration. FIG. 4D shows the front of the envelope in the folded configuration enclosing a rectangular piece of artwork. The edges of the artwork are congruent with the fold lines, thus fill the envelope in the folded configuration. The flaps fold behind the artwork and cannot be seen.

Figure 2:
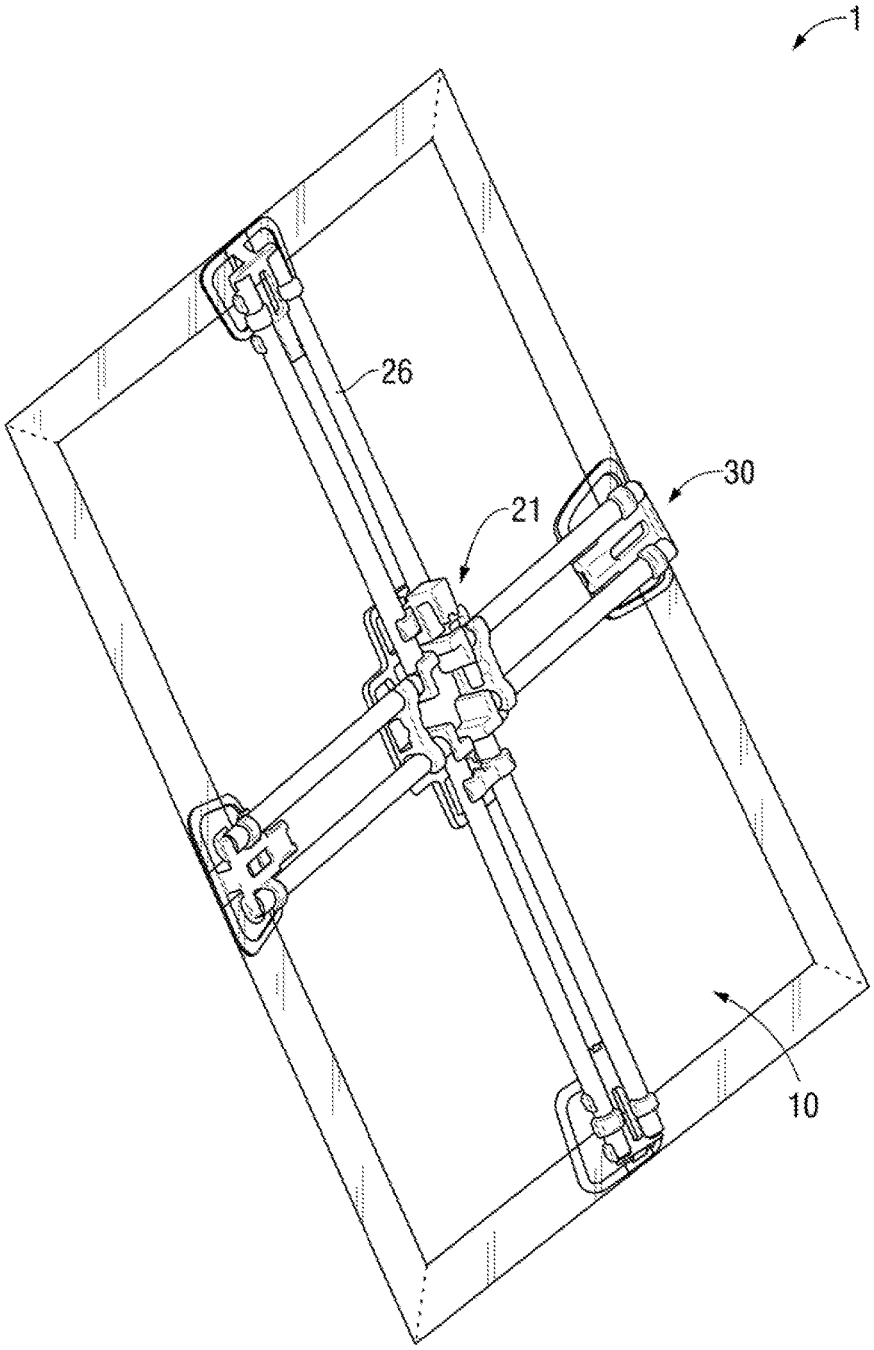
FIG. 2 is a perspective view of the frameless flat artwork mounting and display apparatus

FIG. 2 shows brace 20 in more detail. Artwork is not shown here, for clarity and simplicity. A back view of the brace 20 is shown here holding an envelope 10 in the folded configuration. Brace 20 comprises a hub 21 and four pairs of parallel rods 26 radiating therefrom 90 degrees from each other. Each pair of parallel rods 26 snaps into the hub at one end and, at an opposing end, snaps into to a clip 30. Each clip 30 in turn retains a midpoint of one flap of the envelope 10. In this way, the artwork is held taut, notably not by tension, but rather by the envelope fitting perfectly into the brace. Preferably, the hub 21 and clips 30 are injection molded from 10% glass-filled polypropylene (GFPP). This blend is stronger than pure polypropylene, but flexible enough to allow the hub and into the clip to bend slightly while the pair of parallel rods is snapped thereinto, without the hub and clip breaking. Other compounds can be used to make the hub 21 and clips 30 as long as they are both strong and flexible.

In the embodiment shown, the hub is 2.6 inches across in its largest dimension, but other dimensions can be created without undue experimentation by those of ordinary skill in the art, without deviating from the scope of this invention. In the embodiment shown, the clip is 1.743 inches wide, 1.48 inches tall and 0.400 deep, but again, these dimensions can be varied by someone of ordinary skill in the art.

Each rod in the pair of parallel rods 26 is made preferably from 30% GFPP, although a nylon plastic blend can also be used. The advantage of GFPP is that it is stronger than pure plastic, and has a matte texture which increases static cling friction with the wrong side of the flat artwork. Preferably, each rod in the pair of parallel rods has a diameter of 0.232 inch, but other dimensions can be used and still be within the scope of this invention. The length of the rods can be varied and customized to accommodate the length and width of a particular artwork.

Figure 3:
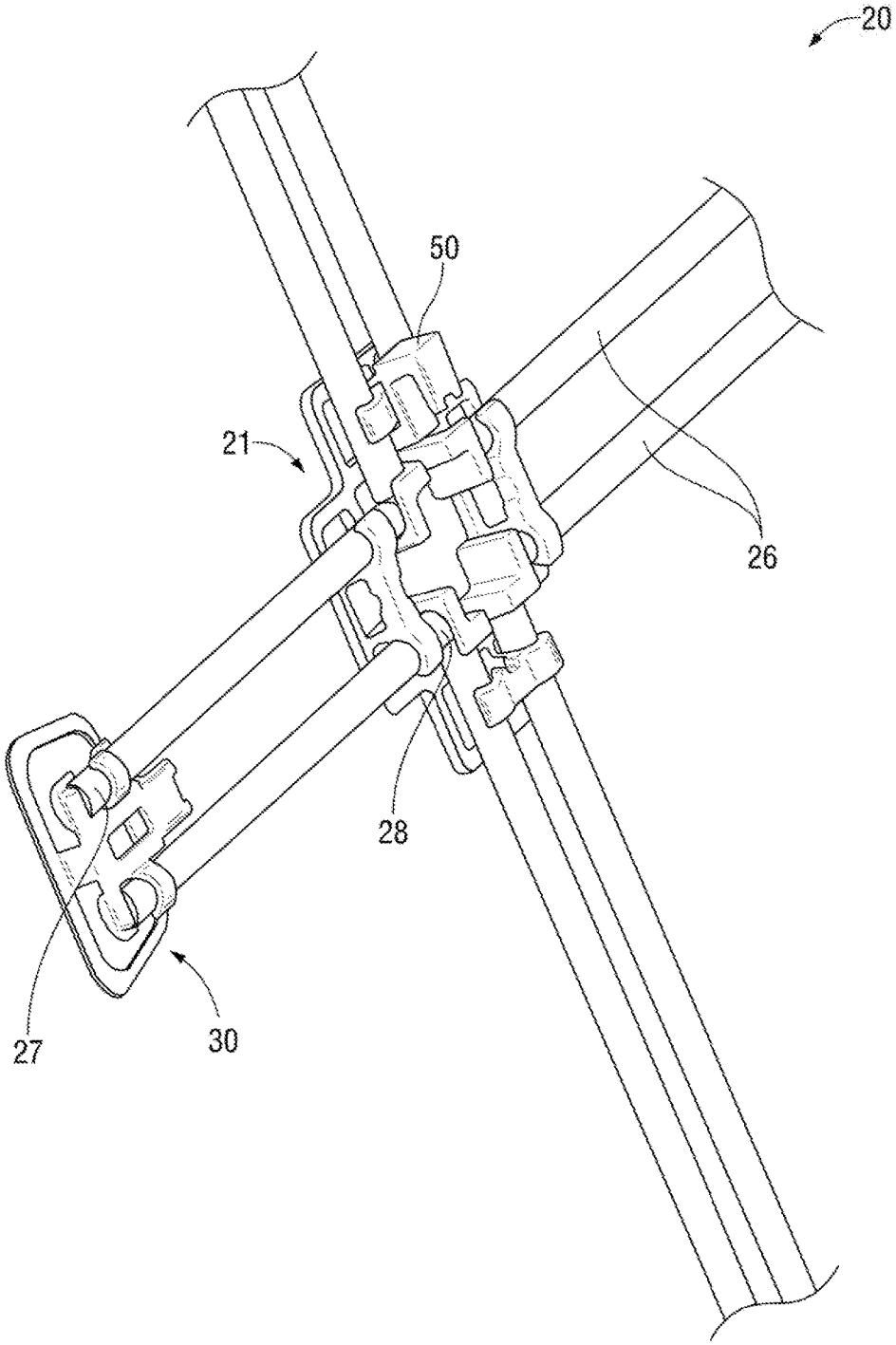
FIG. 3 is a close-up perspective view of the frameless flat artwork mounting and display apparatus

FIG. 3 shows the brace in more detail, in particular, how each pair of spaced-apart parallel rods snaps into both the hub 21 and, at an opposing end, into a clip 30. On the back of both the hub 21 and clip 30 can be found a pair of C-shaped rod retainer elements 24 and 35, respectively. A hub end of each rod is snapped into the C-shaped rod retainer elements 24 on the hub. A clip end of each rod is snapped tightly into the C-shaped rod retainer elements 35 on the front of the clip. These C-shaped rod retainer elements prevent the rod from shifting outside the retainer. The C shapes have an interior diameter equal to the diameter of the rod, so that the retainer element securely holds the rod when it is snapped in. Each pair of rod retainer elements 24, 35 on both the hub and on the front of the clip, respectively, are spaced apart the same distance on both the hub 21 and the front of the clip 30 so that when a pair of rods is snapped therein, the rods are tightly held parallel to each other. The space between the rods can be varied by one of ordinary skill in the art. In the embodiment shown, the distance is approximately 1 inch. An advantage of bracing the artwork with pairs of spaced-apart parallel rods, is that it prevents the artwork from twisting in place. Prior art braces have only single rods or spokes, and are prone to twisting. Note also stops 25 integrated into the hub and stops 36 integrated into the clip. These stops prevent the hub and clip, respectively, from sliding up and down the rods.

Figure 5A:
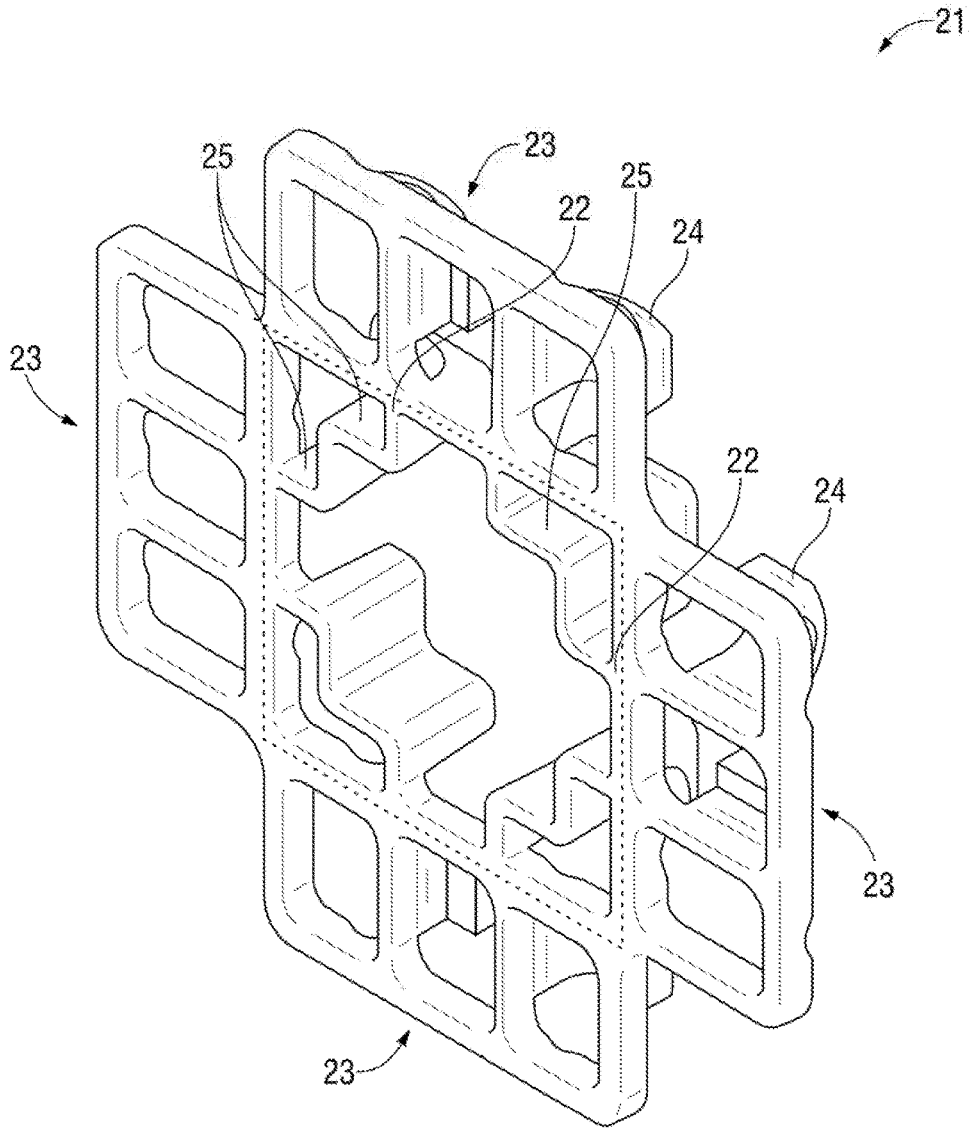
FIG. 5A is a rear view of a hub
Figure 5B:
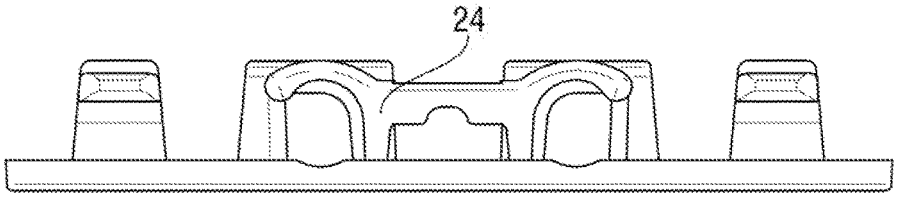
FIG. 5B is a side view of the hub
Figure 5C:
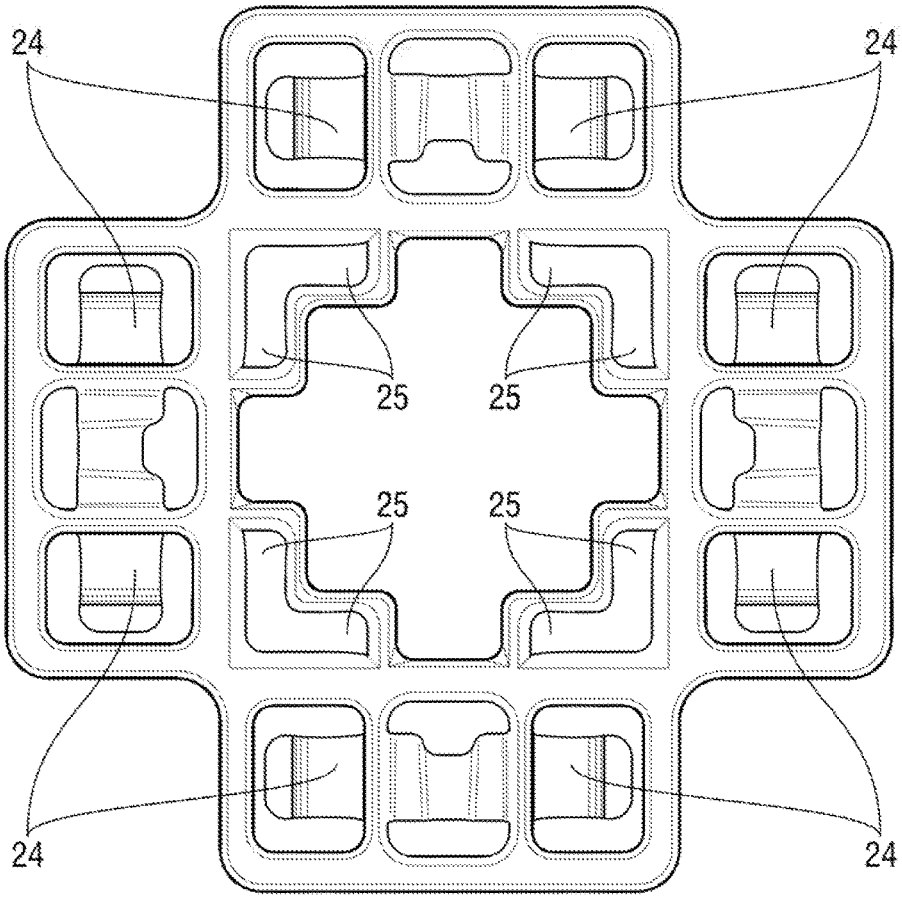
FIG. 5C is a front view of the hub

Details of the hub 21 are shown in FIGS. 5A, 5B and 5C. In a preferred embodiment, shown here, the hub is shaped like a plus sign, comprising a central square 22 and a coplanar extension 23 radiating from each side of the square. However, other hub shapes are entirely possible and within the scope of this invention. FIG. 5A presents a view of the back. Seen more clearly in FIG. 5A are the stops 25 that prevent the hub from sliding along the pair of spaced-apart parallel rods. A rod is snapped into a C-shaped rod retainer element 24 such that the hub end 27 of the rod abuts a corresponding stop 25. This is repeated for all eight rods in this embodiment.

FIGS. 7A, 7B, 7C and 7D show the clip in more detail. Notably, the clip has a planar front 31, which is parallel to the plane of a back 32. The front and the back of the clip are joined by a top bar 33 and a bottom bar 34, creating a space therebetween. The top bar 33 and the bottom bar 34 each have a width. Extending forward from the back of the clip and into this space are two sets of rod retainer elements 35. In the embodiment shown, each set rod of retainer element has a three C-shaped projections. Other similar means of securely but releasably coupling the rods to the clip are possible and within the scope of this invention. Note particularly in FIG. 7D stop 36. There are a pair of stops 36 on each clip, which prevents the clip from sliding along the pair of spaced-apart parallel rods. Top bar 33 and bottom bar 34 each have two purposes. They join the front and the back of the clip and prevent twisting. Top bar 33 also positions the envelope flap 12 upon the clip. The width of top bar 33 is the same as slot 13 so that the tab 14 of envelope flap 12 rests thereupon. In this position, the envelope flap 12 stays in one position. Note also that the bottom bar 34 rests upon wall mount 40, further preventing the apparatus from shifting in place. Please see FIG. 6. Lastly, projecting downward from the back of the clip in roughly the same plane is a plug 37. The plug fits into both the wall mount and also into a female element of a forward extension bracket, to be discussed in more detail later.

Figure 6:
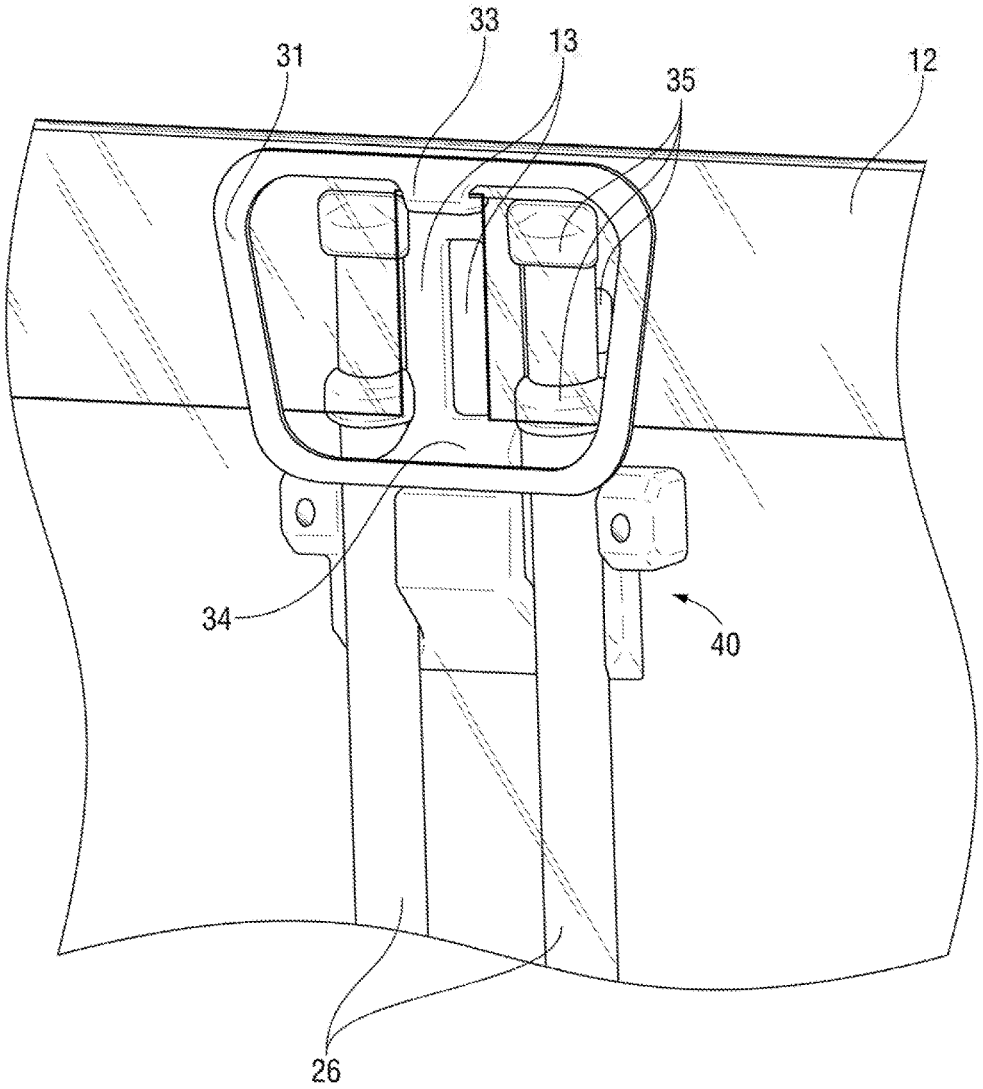
FIG. 6 is a close-up perspective view of the frameless flat artwork and display apparatus
Figure 7B:
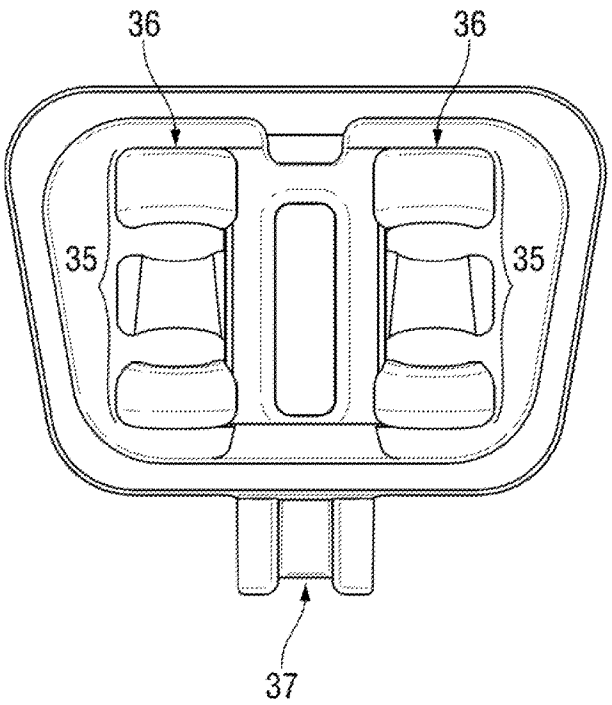
FIG. 7B is a front view of the clip
Figure 7A:
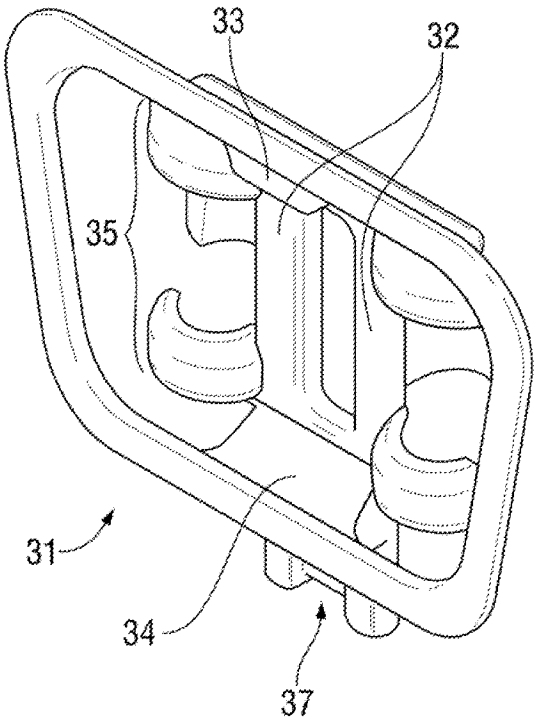
FIG. 7A is a perspective view of a clip
Figure 7D:
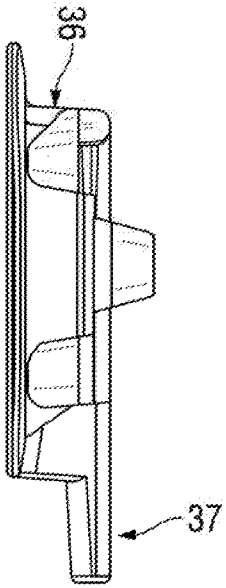
FIG. 7D is a side view of the clip
Figure 7C:
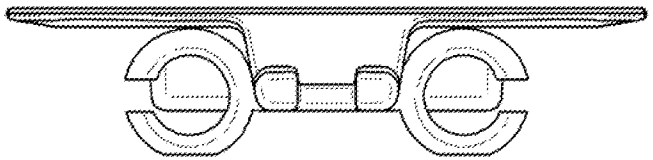
FIG. 7C is a bottom view of the clip
Figure 8A:
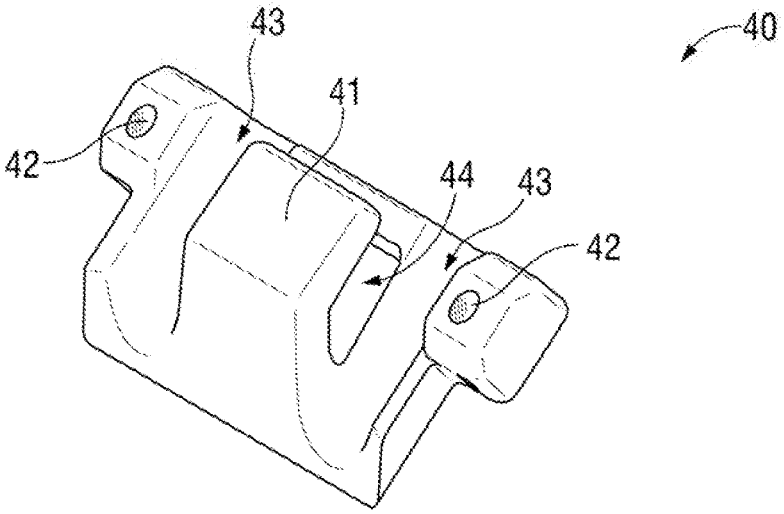
FIG. 8A is a perspective view of a wall mount
Figure 8B:
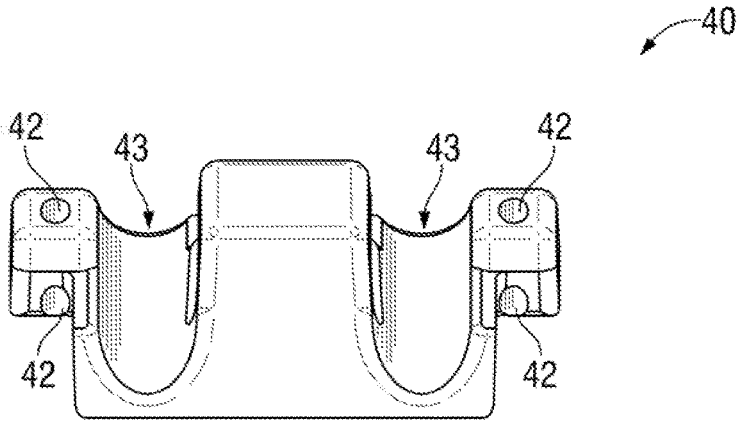
FIG. 8B is a front view of the wall mount
Figure 8C:
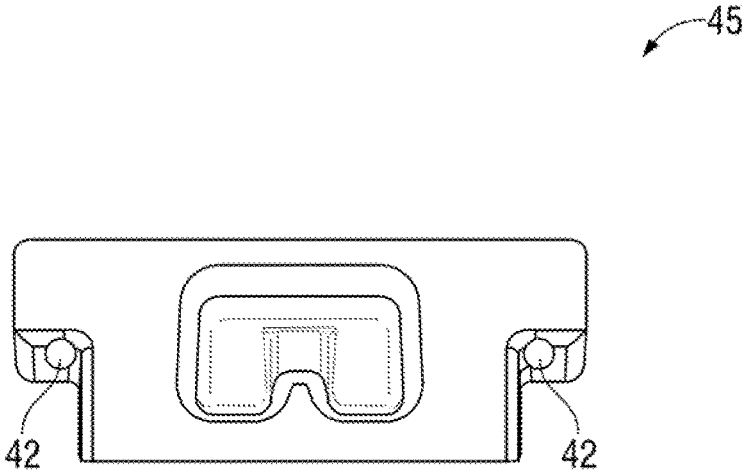
FIG. 8C is a bottom view of the wall mount
Figure 8D:
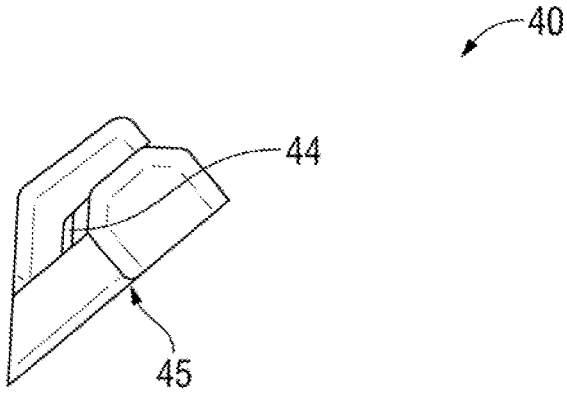
FIG. 8D is a side view of the wall mount

In FIG. 6, one can see in detail how the envelope is attached to the clip. Slot 13 is slid over top bar 33 so that tab 14 (not shown) rests thereupon. Flap 12 rests in the space between the front and the back of the clip. The area of the envelope within the four fold lines sits in front of the front of the clip. In other words, the clip is sandwiched between the front of the envelope and each flap. If opaque artwork is enclosed within the envelope, the clips would be hidden behind the artwork.

FIGS. 8A, 8B, 8C and 8D show the wall mount 40 in greater detail. Wall mount 40 has a front-facing side 41 and a back-facing side 45. From the front-facing side is cut a pair of spaced-apart slots 43. These slots are where the pair of spaced-apart rods lay. Thus, the wall mount supports the brace in part by the pair of parallel rods. Preferably, the wall mount is molded from 30% GFPP, although other materials which perform similarly may also be used.

In the embodiment shown, the slots are spaced 1 inch apart, but this can be varied by someone of ordinary skill of the art without departing from the spirit of this invention. The portion of the front-facing side between the slots projects frontward in space and supports the bottom bar 34 of the clip. The wall mount therefore supports and stabilizes the apparatus in two ways—by the bottom bar resting atop the projection and by the plug fitting into the groove. Fastener positioning holes 42 run through the entire wall mount 40 and permanently secure the wall mount to a wall. One can use nails, screws or anchors, or any other permanent fastener known to those of ordinary skill in the art. Alternatively, one can secure the wall mount to the wall without fastener, such as with permanent or temporary adhesive.

Figure 9:
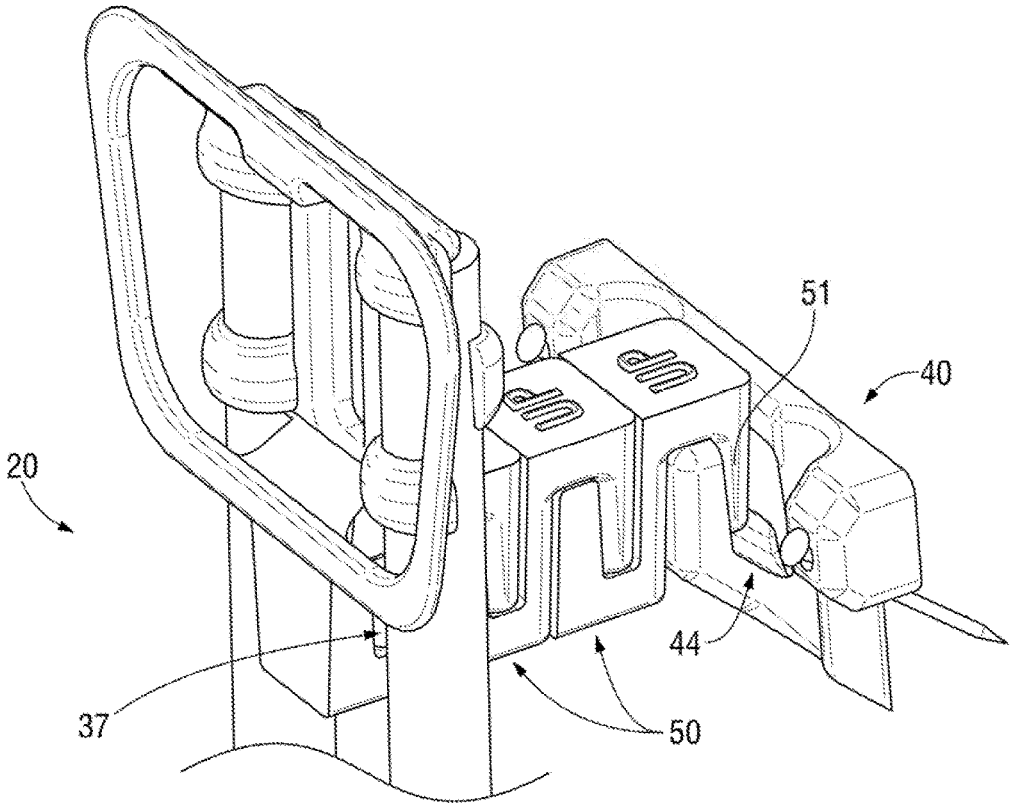
FIG. 9 is a close-up perspective view of the frameless flat artwork and display apparatus as coupled to the wall mount with three extension brackets
Figure 10B:
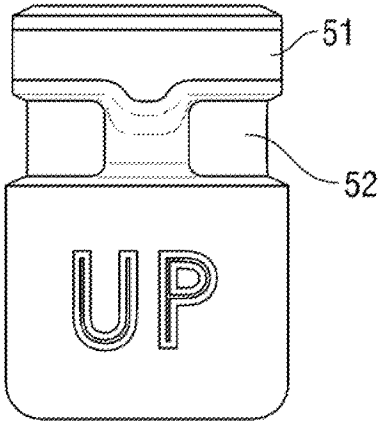
FIG. 10B is a top view of the extension bracket
Figure 10A:
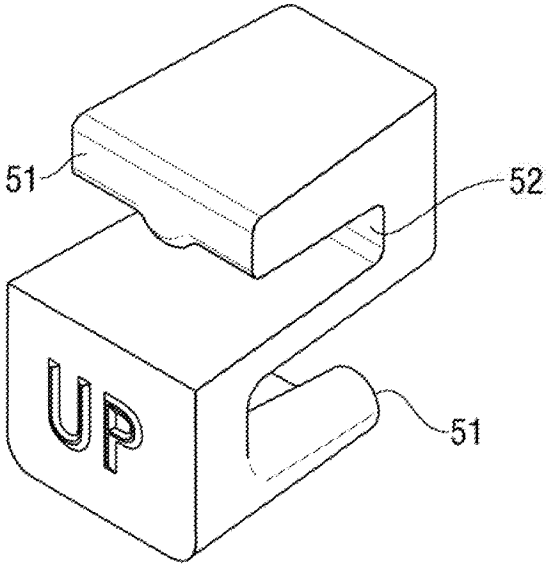
FIG. 10A is a perspective view of one such extension bracket
Figure 10D:
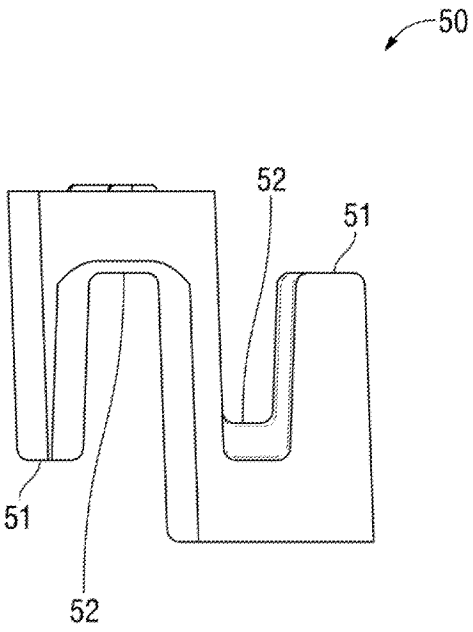
FIG. 10D is a side view of the extension bracket
Figure 10C:
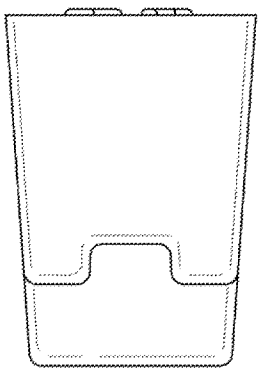
FIG. 10C is a front view of the extension bracket

FIG. 9 depicts an alternative embodiment of this invention, where the brace 20 is not laid directly into the wall mount 40, but rather is coupled indirectly to the wall mount with at least one forward extension bracket 50 there between. In the embodiment shown, three forward extension brackets are used. These brackets push the brace 20 further forward from the wall. As shown in more detail in FIGS. 10A, 10B, 10C and 10D, each forward extension bracket has two male elements and two female elements 52. Preferably the wall mount is injection molded from a 30% GFPP blend although other materials which perform similarly may also be used.

To connect the brace 20 to the wall mount, a first male element 51 slides into groove 44. The second male element 51 slides into and supports either a first female element 52 of another forward extension bracket, as shown in FIG. 9, or in front of plug 37. Plug 37 is congruent with male element 51 such that both the plug and the male element can interlock with the female element at any given time. In the embodiment shown, the forward extension bracket 50 is shaped like a letter N, but other shapes and configurations enabling the male elements to interlock completely within its own female elements and also the groove are also within the scope of this invention.

I claim:

1. An apparatus for mounting and displaying flat artwork without a frame, comprising:

a. a rectangular envelope with four edges, a right side, a wrong side, and a first set of four fold lines, wherein the first set of four fold lines define:
   i. a first rectangular area within the first set of four fold lines, and
   ii. four flaps outside of the first set of four fold lines, wherein
   the flat artwork fills and covers the wrong side of the first rectangular area and the four flaps fold to the wrong side along the first set of four fold lines to enclose the flat artwork there between;

b. a brace, comprising a hub and four pairs of spaced-apart parallel rods, each pair of spaced-apart parallel rods radiating from the hub and perpendicular to and coplanar with each other, each such pair of parallel rods having a hub end and clip end;

c. a clip affixed to the clip end of each of the four pairs of spaced-apart parallel rods, each clip further comprising:

i. a front, ii. a back, iii. a space between the front and the back iv. a top bar joining the front of the clip to the back of the clip, v. a bottom bar also joining the front of the clip to the back of the clip, and vi. a plug depending from the back of the clip, wherein the space between the front and the back of each such clip retains a midpoint of a corresponding flap of the rectangular envelope; and d. a wall mount with a pair of spaced-apart slots dimensioned to retain any one of the four pairs of spaced-apart parallel rods, and a groove located between each slot.

2. The apparatus of claim 1, wherein both the hub and the back of the clip further comprise a pair of spaced-apart rod retainer elements dimensioned to retain by snap fit a pair of spaced-apart parallel rods.

3. The apparatus of claim 2, wherein the spaced-apart rod retainer elements of both the hub and the clip further comprise a stop, wherein the stop is dimensioned to prevent both the hub and the clip from sliding along the pair of spaced-apart parallel rods.

4. The apparatus of claim 3, wherein each of the four flaps has a retention slot cut thereinto perpendicular to the edge of the rectangular envelope, toward a geometric center of the rectangular envelope, stopping short of the fold line, creating a tab.

5. The apparatus of claim 4, further comprising a forward extension bracket with two male elements and two female elements, each such male element dimensioned to insert into the groove of the wall mount, into the hub, and into each female element, and wherein the each female element is dimensioned to accept a male element of another forward extension bracket.

6. The apparatus of claim 5, further comprising a second set of four fold lines within the first rectangular area, wherein the second set of four fold lines define:

i. a second rectangular area within the second set of four fold lines, and ii. four flaps outside of the second set of four fold lines, wherein the flat artwork fills and covers the wrong side of the second rectangular area and the four flaps fold to the wrong side along the first and the second set of four fold lines to enclose the flat artwork there between.

* * * * *